US009551348B2

(12) United States Patent
Lin et al.

(10) Patent No.: US 9,551,348 B2
(45) Date of Patent: Jan. 24, 2017

(54) SLIM-TYPE FAN STRUCTURE

(71) Applicant: COOLER MASTER CO., LTD., New Taipei (TW)

(72) Inventors: Fu-Lung Lin, New Taipei (TW); Shih-Wei Huang, New Taipei (TW); Shui-Fa Tsai, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 235 days.

(21) Appl. No.: 14/478,789

(22) Filed: Sep. 5, 2014

(65) Prior Publication Data

US 2015/0132162 A1 May 14, 2015

(30) Foreign Application Priority Data

Nov. 8, 2013 (CN) ..... 2013 2 0706084 U

(51) Int. Cl.

| | |
|---|---|
| ***F04D 25/00*** | (2006.01) |
| ***F04D 25/06*** | (2006.01) |
| ***F04D 29/28*** | (2006.01) |
| ***F04D 17/16*** | (2006.01) |

(52) U.S. Cl.

CPC ..... *F04D 25/0653* (2013.01); *F04D 17/16* (2013.01); *F04D 29/281* (2013.01)

(58) Field of Classification Search

CPC .. F04D 25/06; F04D 25/0653; F04D 13/0666; F04D 29/281

USPC ..... 417/423.1, 423.7, 424.2

See application file for complete search history.

(56) References Cited

U.S. PATENT DOCUMENTS

| | | | | |
|---|---|---|---|---|
| 6,713,907 | B2 * | 3/2004 | Matsumoto | F04D 25/0613 310/254.1 |
| 6,896,476 | B2 * | 5/2005 | Hung | F04D 25/0606 310/90.5 |
| 6,926,498 | B2 * | 8/2005 | Li | F04D 29/626 310/156.26 |
| 7,071,587 | B2 * | 7/2006 | Lopatinsky | F04D 17/04 257/E23.099 |
| RE39,787 | E * | 8/2007 | Matsumoto | F04D 25/082 415/58.2 |
| 7,291,956 | B2 * | 11/2007 | Itoh | H02K 3/26 310/208 |
| 7,862,309 | B2 * | 1/2011 | Chen | F04D 29/626 415/220 |

(Continued)

*Primary Examiner* — Charles Freay
*Assistant Examiner* — Christopher Bobish
(74) *Attorney, Agent, or Firm* — Chun-Ming Shih; HDLS IPR Services

(57) ABSTRACT

A slim-type fan structure includes a stator (1) and a fan blade (2). The stator includes a circuit board (11) and a plurality of layout circuits (12) disposed to circumference the circuit board (11). The stator (1) includes an axial center (10) at a center portion thereof. The fan blade (2) includes a blade wheel (20), an axial sleeve (21) at a center of the blade wheel (20) and extended axially therefrom, a plurality of blades (22) formed to circumference an outer of the blade wheel (20), and a magnetic unit (23) disposed on the blade wheel (20). Also, the axial sleeve (21) is pivotally attached to the axial center (10). Accordingly, the magnetic unit (23) is formed by a plurality of N and S pole areas (230), (231) arranged alternatively in circular rows and corresponding to the layout circuits (12) along a vertical direction for the slim design.

6 Claims, 6 Drawing Sheets

(56) References Cited

U.S. PATENT DOCUMENTS 8,177,530 B2 * 5/2012 Horng ..... F04D 25/0653 310/156.32
8,297,950 B2 * 10/2012 Horng ..... F04D 25/0653 417/423.14
8,360,747 B2 * 1/2013 Horng ..... F04D 25/0653 310/156.32
8,419,385 B2 * 4/2013 Horng ..... F04D 25/0653 310/156.32
8,684,709 B2 * 4/2014 Huang ..... F04D 25/0693 310/68 R
8,974,194 B2 * 3/2015 Yin ..... F04D 25/0606 417/420
9,022,751 B2 * 5/2015 Zheng ..... F04D 17/04 417/420
2002/0021973 A1 * 2/2002 Nelson ..... F04D 25/066 417/355
2004/0234391 A1 * 11/2004 Izraelev ..... A61M 1/101 417/410.1
2005/0063842 A1 * 3/2005 Park ..... F04D 25/066 417/423.1
2005/0121996 A1 * 6/2005 Lopatinsky ..... H02K 7/14 310/268
2005/0147501 A1 * 7/2005 Cheng ..... F04D 25/0606 417/53
2007/0114869 A1 * 5/2007 Horng ..... F04D 25/0653 310/156.32
2009/0148086 A1 * 6/2009 Kuo ..... H02K 1/30 384/440
2010/0028177 A1 * 2/2010 Horng ..... F04D 25/08 417/423.7
2013/0028764 A1 * 1/2013 Yokozawa ..... F04D 5/006 417/423.7
2013/0058807 A1 * 3/2013 Shan ..... F04D 25/0653 417/410.1
2013/0171014 A1 * 7/2013 Horng ..... F04D 17/04 417/423.7

* cited by examiner

SLIM-TYPE FAN STRUCTURE

BACKGROUND OF THE INVENTION

Field of the Invention

The present invention is related to a heat dissipating fan, in particular, to a slim-type fan structure.

Description of Related Art

As the technology of the computer industry advances, fans have become one of the essential components for heat dissipation in the computer nowadays. These fans are able to not only satisfy the needs for heat dissipation but also configured to cope with the lighter and slimmer designs of computers or 3C products in order to overcome the limitations on the available space and the dimensional requirements as well as the considerations on the reduction of the weight for lighter products.

However, currently, a typical heat dissipating fan must include a stator and a rotator; wherein the rotator refers to the fan blade of the fan, and for a conventional fan blade, it includes at least one blade wheel and a plurality of blades arranged at the outer perimeter of the blade wheel. In addition, a magnetic unit is disposed inside the blade wheel in order to perform an electromagnetic induction with the stator. Furthermore, the center of the blade wheel further includes an axial center or an axial sleeve provided for a pivotal arrangement thereon. Therefore, obviously, such known fan blade is not simplified in its structure nor configured to be slim in the structure; as a result, it is an assembly structure that requires each component part to be assembled with each other. Moreover, since each component part needs to be made of a heavier material, the overall structure is not slim in its dimension nor is light in weight, which may even require more assembly procedures and may involve greater costs during the manufacturing thereof. Therefore, there is a need for an improvement.

In view of the above, the inventor seeks to overcome the aforementioned drawbacks of the currently existing technique and provides an improvement after years of research and development along with the use of academic principles in light of solving the aforementioned problems.

SUMMARY OF THE INVENTION

An objective of the present invention is to provide a slim-type fan structure, which is able to utilize a stator of the fan being made from a circuit board and a plurality of layout circuits disposed thereon in order to achieve the slim design of the fan.

Another objective of the present invention is to provide a slim-type fan structure, which is able to further allow the fan blade of the fan to be integrally formed of a magnetic material in order to achieve the slim design of the fan.

To achieve the aforementioned objective, the present invention provides a slim-type fan structure comprising: a stator, a fan blade and a fan shield. The stator further comprises a circuit board and a plurality of layout circuits disposed to circumference the circuit board, and the stator includes an axial center at a center portion thereof. The fan blade comprises a blade wheel, an axial sleeve arranged at a center of the blade wheel and extended axially therefrom, a plurality of blades formed to circumference an outer of the blade wheel, and a magnetic unit disposed on the blade wheel. In addition, the axial sleeve is configured to pivotally attach to the axial center. The fan shield covers an outer of the fan blade, and the fan shield includes a fixation portion provided to secure the axial center. According to the above, the magnetic unit is formed by a plurality of N pole areas and a plurality of S pole areas arranged alternatively in circular rows and arranged corresponding to the plurality of layout circuits along a vertical direction in order to achieve the slim-type fan structure.

To achieve the aforementioned another objective, the present invention provides a slim-type fan structure; wherein the magnetic unit of the fan blade is manufactured by mixing a magnetic material with a material of the fan blade in order to integrally form the fan blade.

DETAILED DESCRIPTION OF THE INVENTION

The following provides a detailed description of the present invention along with the accompanied drawings; however, it shall be understood that the accompanied drawings are provided for illustrative purposes only, which shall not be treated as limitations of the present invention.

Figure 1:
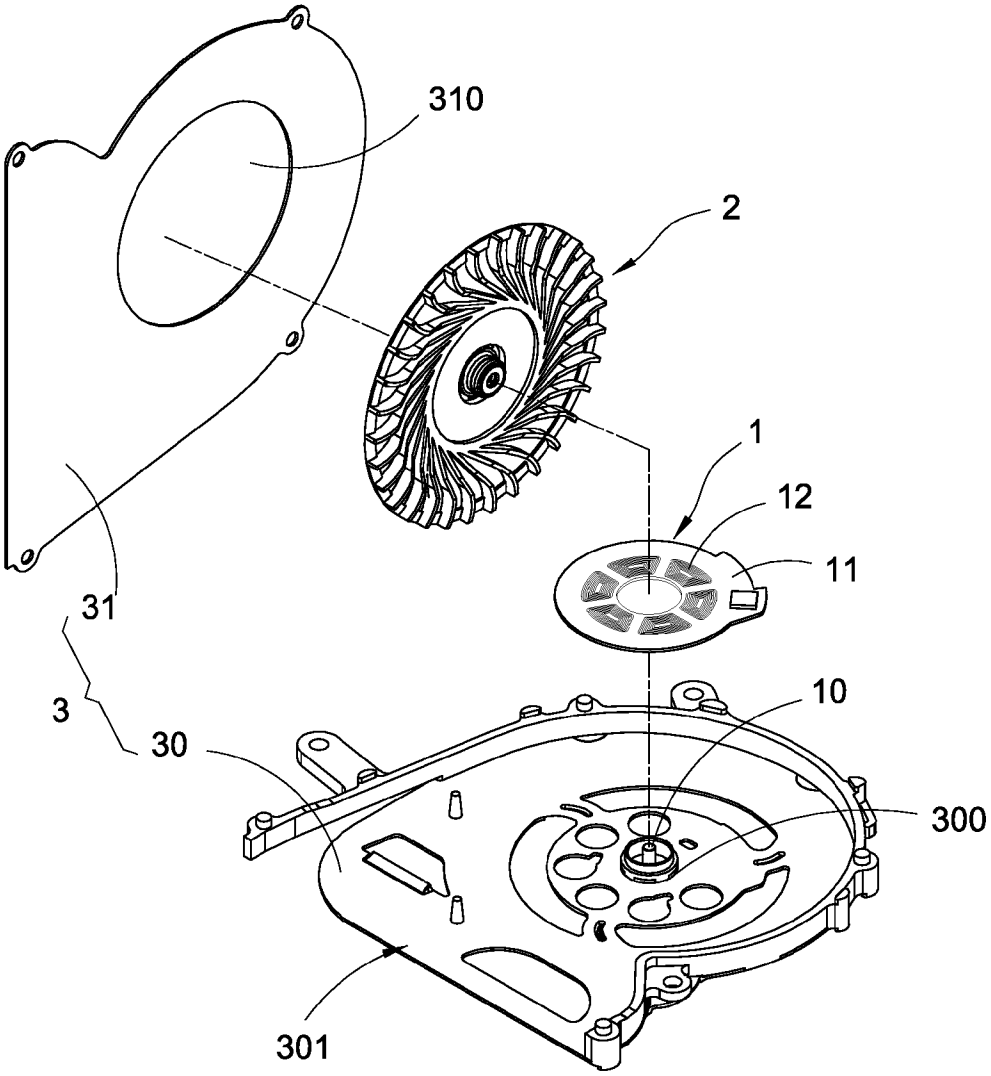
FIG. 1 is an exploded perspective view of the present invention.
Figure 2:
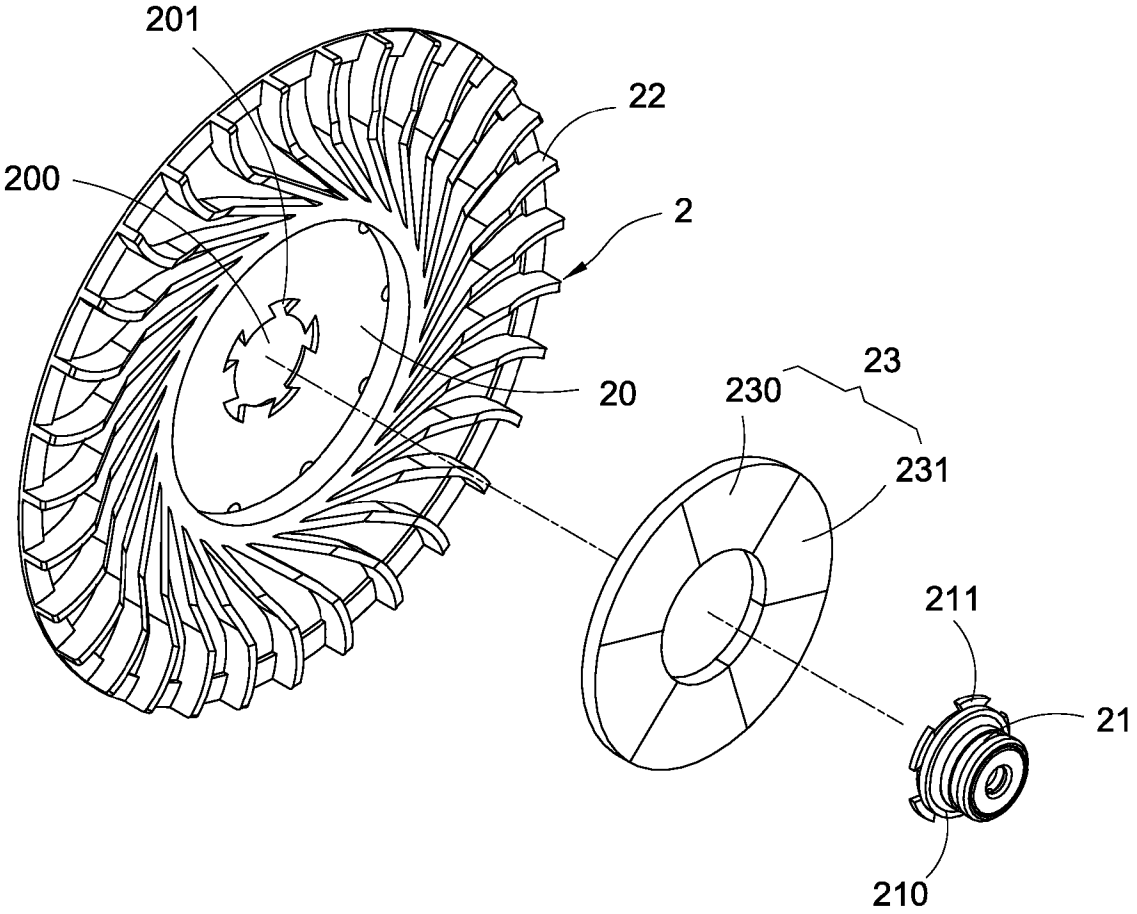
FIG. 2 is an exploded perspective view of the fan blade of the present invention.

Please refer to FIG. 1 to FIG. 2, showing an exploded perspective view of the present invention and an exploded perspective view of the fan blade of the present invention respectively. The present invention provides a slim-type fan structure, and the fan structure comprises a stator 1 and a fan blade 2.

Figure 3:
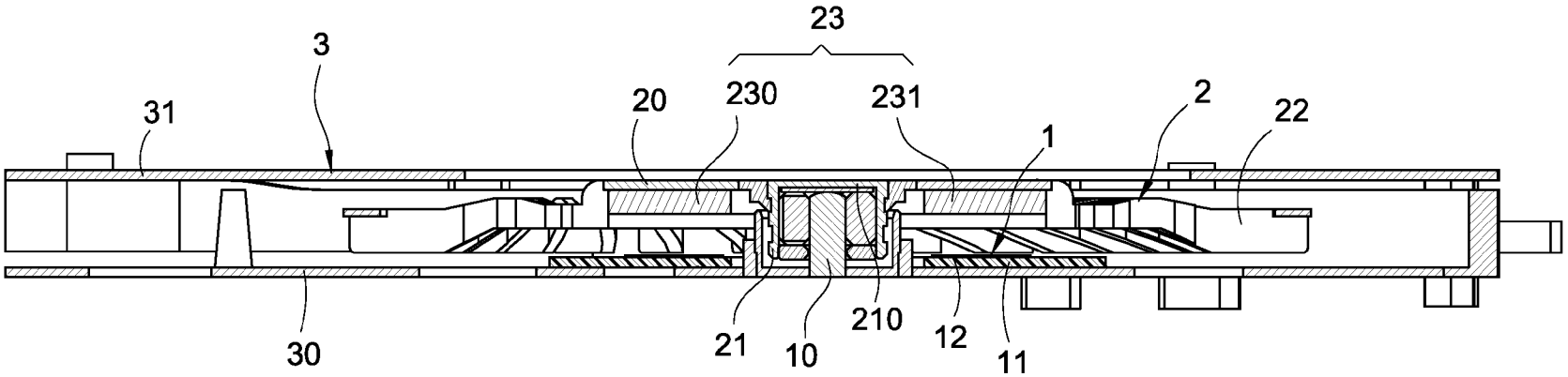
FIG. 3 is a cross sectional view of the assembly of the present invention.

Accordingly, the stator 1 is a motor of the fan and includes an axial center 10 at a center portion thereof and provided to pivotally attach to the fan blade 2 (as shown in FIG. 3). In addition, the stator 1 is mainly constructed by a circuit board 11 and a plurality of layout circuits 12 disposed to circumference the circuit board 11 such that by using the circuit board 11 to control the electrical conduction of the stator 1 and by utilizing the plurality of layout circuits 12 to generate an electromagnetic effect, the aforementioned fan blade 2 can be driven for rotations.

Figure 4:
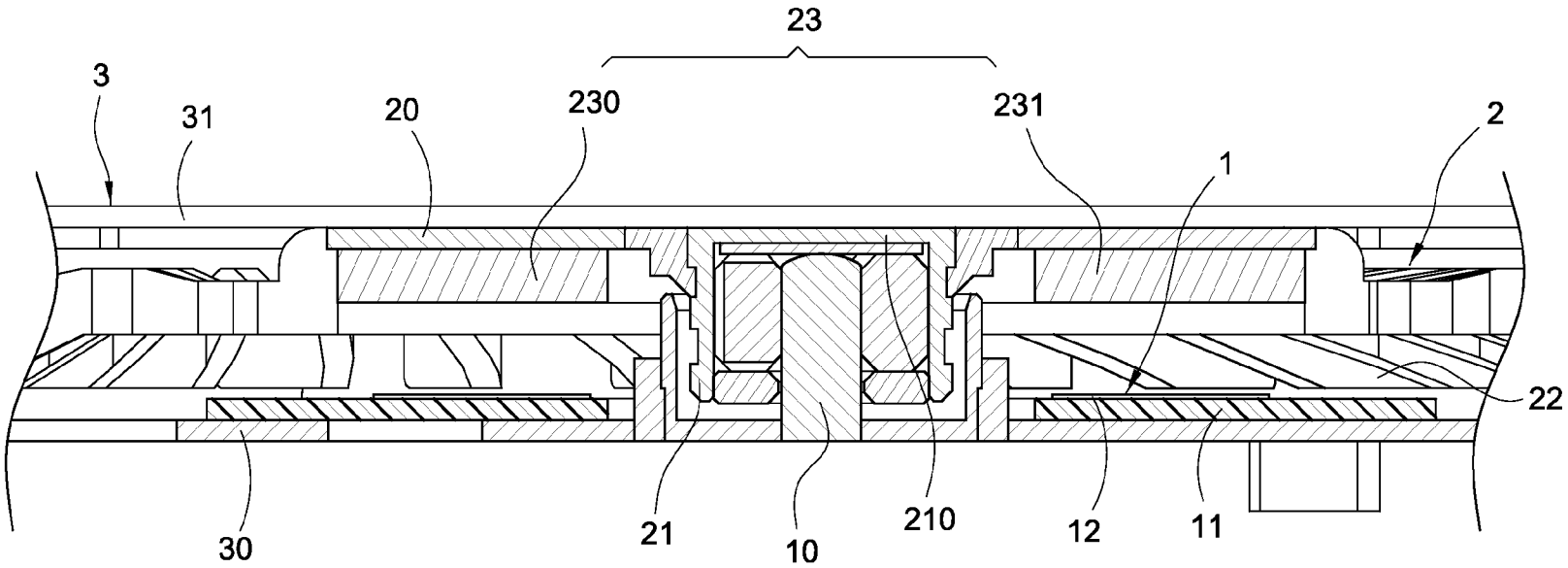
FIG. 4 is a cross sectional view of a partial assembly of the present invention.

Please refer to FIG. 2 again. The fan blade 2 comprises a blade wheel 20, an axial sleeve 21 arranged at a center of the blade wheel 20 and extended axially therefrom, a plurality of blades 22 formed to circumference an outer of the blade wheel 20, and a magnetic unit 23 disposed on the blade wheel 20. In addition, the axial sleeve 21 is pivotally attached to the axial center 10 of the aforementioned stator 1. Furthermore, in this embodiment of the present invention, the blade wheel 20 further includes a fixation hole 200 formed at a center portion thereof, and the axial sleeve 21 includes a fixation edge 210 formed thereon and inserted into the fixation hole 200. Also, the fixation edge 210 further includes a plurality of insertion members 211 formed to circumference an outer thereof; whereas the fixation hole 200 includes a plurality of corresponding insertion slots 201 formed to circumference an outer edge thereof in order to allow the axial sleeve 21 to be more stably inserted into the blade wheel 20 of the fan blade 2. Moreover, as shown in FIG. 3 and FIG. 4, the magnetic unit 23 is formed by a plurality of N pole areas 230 and a plurality of S pole areas 231 arranged alternatively in circular rows and arranged corresponding to the plurality of layout circuits 12 of the aforementioned stator 1 along a vertical direction, such as in a top-down manner; therefore, they are able to generate an electromagnetic effect together with the plurality of layout circuits 12 in order to drive the fan blade 2 to rotate in an operation.

In addition, please refer to FIG. 1 and FIG. 3. The fan can further comprise a fan shield 3. The fan shield is covered onto the outer of the fan blade 2 and comprises a base 30 and a shield cover 31. The base 30 includes a fixation portion 300 provided to allow the stator 1 to be secured thereon as well as to allow the axial center 10 to be positioned therein in order to be vertically secured onto the base 30. Furthermore, the base 30 includes a first air opening 301 formed on one side thereof; whereas the shield cover 31 covers onto the base 30 and includes a second air opening 310 formed thereon and opposite from the fan blade 2. The aforementioned first and second air openings 301, 310 can be an air inlet and an air outlet respectively, which can also be modified depending upon the actual direction of the rotation of the fan blade 2.

Figure 5:
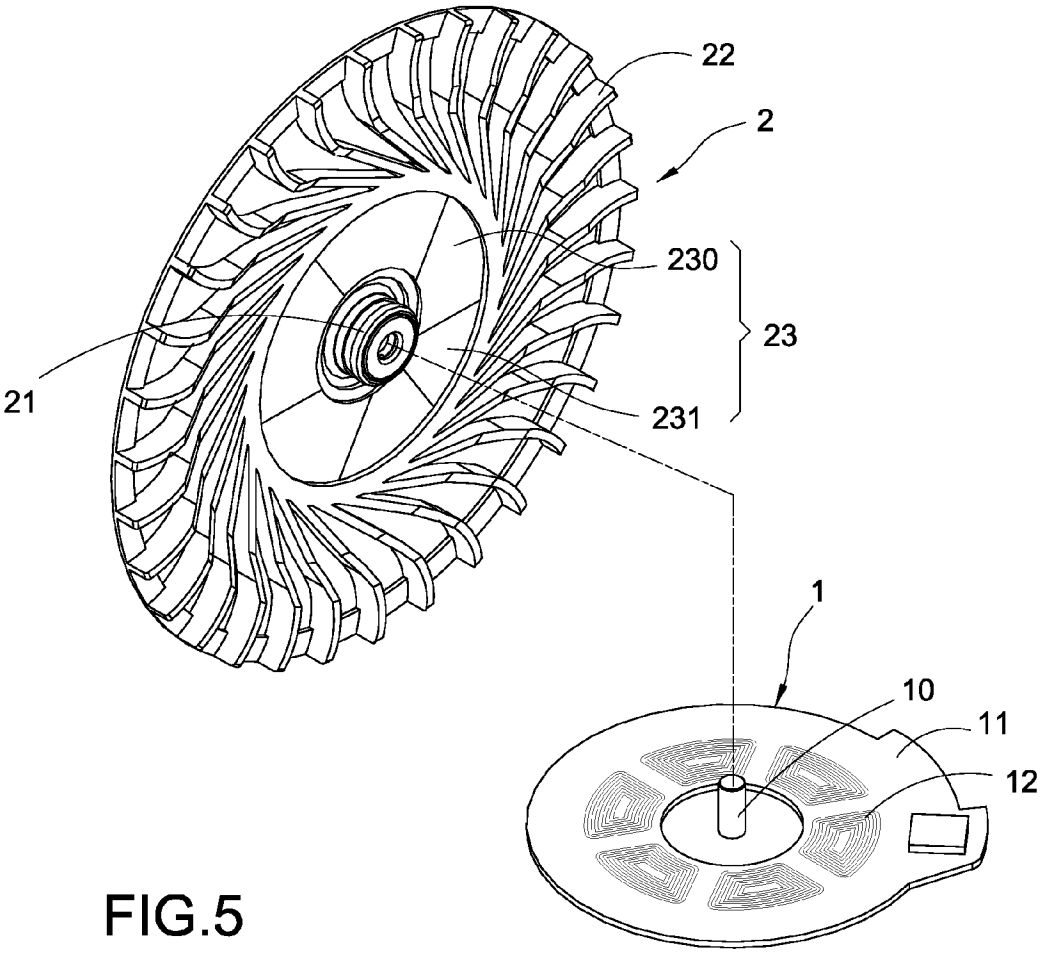
FIG. 5 is an exploded perspective view of another embodiment of the present invention.
Figure 6:
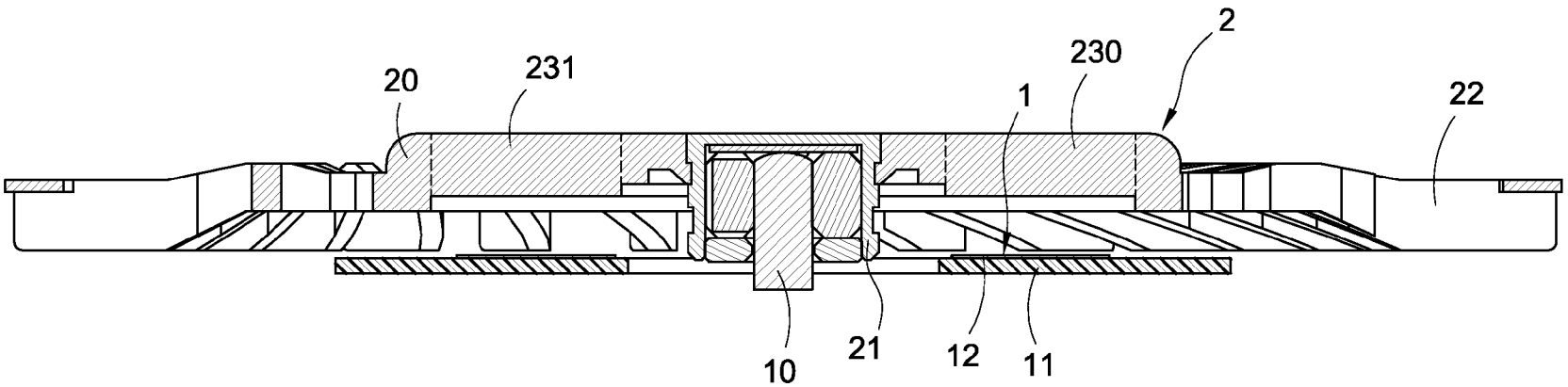
FIG. 6 is a cross sectional view of the assembly of another embodiment of the present invention.

Furthermore, as shown in FIG. 5 and FIG. 6, in another embodiment of the present invention, the magnetic unit 23 of the fan blade 2 is manufactured by mixing a magnetic material, such as a magnetic powder, with a material of the fan blade 2 in order to integrally form the fan blade 2. In this embodiment, the aforementioned magnetic material contained in the fan blade 2 can be distributed throughout the blade wheel 20 opposite from the stator 1, which is also formed by a plurality of N pole areas 230 and a plurality of S pole areas 231 arranged alternatively in circular rows and arranged corresponding to the plurality of layout circuits 12 of the aforementioned stator 1 along a vertical direction, such as in a top-down manner, in order to circumference an upper area of the stator 1. Therefore, the blade wheel 20 of the fan blade is able to have the magnetism according to the polarity of the N pole areas 230 and the S pole areas 231 such that once the stator 1 is electrically conducted, it is able to generate an electromagnetic effect together with the plurality of layout circuits 12 for rotations in operation.

According to the above, with the aforementioned structural assembly, a slim-type fan structure of the present invention can be achieved.

As a result, based on the slim-type fan structure disclosed by the present invention, the stator 1 can be mainly constructed from the circuit board 11 and the plurality of layout circuits 12 in order to achieve the slim design of the fan structure. In addition, the fan blade 2 is further integrally formed with a magnetic material mixed therein such that the design of the present invention has the merit of being light in weight. Therefore, the overall performance of the fan can be enhanced and the quality of the product can be increased.

In view of the above, the present invention is novel and is able to achieve the expected objectives mentioned above while overcoming the drawbacks of the prior art, which is of novelty and inventive step. The present invention complies with the requirement for the application of a patent right and is now legitimately disclosed in an application in light of the grant of the patent right.

Nevertheless, the above provides descriptions on the preferred embodiment of the present invention only, which shall not be treated as limitations of the present invention. Any equivalent modifications without deviating from the spirit of the present invention shall be deemed to be within the scope of the present invention.

What is claimed is:

1. A slim-type fan structure comprising:

a stator (1) comprising a circuit board (11) and a plurality of layout circuits (12) disposed to circumference the circuit board (11); the stator (1) having an axial center (10) at a center portion thereof;

a fan blade (2) comprising a blade wheel (20), an axial sleeve (21) arranged at a center of the blade wheel (20) and extended axially therefrom, a plurality of blades (22) circumference an outer of the blade wheel (20) to form a concaved space, and a magnetic unit (23) fittedly disposed inside the concaved space on the blade wheel (20); and the axial sleeve (21) configured to pivotally attach to the axial center (10); and a fan shield (3) covering an outer of the fan blade (2); the fan shield (3) having a fixation portion (300) provided to secure the axial center (10);

wherein the magnetic unit (23) is formed by a plurality of N pole areas (230) and a plurality of S pole areas (231) arranged alternatively in circular rows and arranged corresponding to the plurality of layout circuits (12) along a vertical direction in order to achieve the slim-type fan structure, wherein the blade wheel (20) of the fan blade (2) further includes a fixation hole (200) at a center portion thereof, and the axial sleeve (21) includes a fixation edge (210) inserted into the fixation hole (200), and the fixation edge (210) further forms a plurality of insertion members (211) circumferencing an outer thereof, and an outer surface of the fixation hole (200) further form a plurality of insertion slots (201) with dimensions corresponding to the plurality of insertion members, and wherein when the plurality of insertion members (211) are fitted into the plurality of insertion slots, a side of each insertion member (211) away from the stator (1) is coplanar to a side of the blade wheel (20) away from the stator (1).

2. The slim-type fan structure according to claim 1, wherein the magnetic unit (23) of the fan blade (2) is manufactured by mixing a magnetic material with a material of the fan blade (2) in order to integrally form the fan blade (2).

3. The slim-type fan structure according to claim 2, wherein the magnetic material is a magnetic power.

4. The slim-type fan structure according to claim 3, wherein the magnetic material is distributed throughout the blade wheel (20) opposite from the stator (1).

5. The slim-type fan structure according to claim 1, wherein the fan shield (3) comprises a base (30) and a shield cover (31); the base (30) includes a fixation portion (300) for securing the stator (1); the base (30) includes a first air opening (301) formed on one side thereof; the shield cover (31) covers onto the base (30) and includes a second air opening (310) opposite from the fan blade (2).

6. The slim-type fan structure according to claim 5, wherein the first and second air openings (301), (310) are an air inlet and an air outlet respectively.

* * * * *